US009177513B2

(12) United States Patent
McRae

(10) Patent No.: US 9,177,513 B2
(45) Date of Patent: Nov. 3, 2015

(54) ELECTROLUMINESCENT DISPLAY WHERE EACH PIXEL CAN EMIT LIGHT OF ANY EIA COLOR INDEX

(71) Applicant: Vizio Inc, Irvine, CA (US)

(72) Inventor: Matthew McRae, Irvine, CA (US)

(73) Assignee: Vizio, Inc, Irvine, CA (US)

( * ) Notice: Subject to any disclaimer, the term of this patent is extended or adjusted under 35 U.S.C. 154(b) by 222 days.

(21) Appl. No.: 13/899,677

(22) Filed: May 22, 2013

(65) Prior Publication Data

US 2014/0347400 A1 Nov. 27, 2014

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.

CPC ..... *G09G 3/3607* (2013.01); *G09G 3/3413* (2013.01); *G09G 3/3426* (2013.01); *G09G 3/348* (2013.01); *G09G 2300/046* (2013.01); *G09G 2300/0456* (2013.01); *G09G 2310/0235* (2013.01); *G09G 2320/0242* (2013.01)

(58) Field of Classification Search

CPC ..... G09G 3/3607
USPC ..... 345/88, 690
See application file for complete search history.

(56) References Cited

U.S. PATENT DOCUMENTS

| | | | | |
|---|---|---|---|---|
| 6,936,960 | B2 | 8/2005 | Cok | |
| 7,259,505 | B2 | 8/2007 | Cok | |
| 8,334,545 | B2 | 12/2012 | Levermore et al. | |
| 8,334,859 | B2 | 12/2012 | Liu et al. | |
| 8,354,787 | B2 | 1/2013 | Kim et al. | |
| 2004/0140758 | A1 | 7/2004 | Raychaudhuri et al. | |
| 2006/0012296 | A1 | 1/2006 | Eida et al. | |
| 2008/0122874 | A1 * | 5/2008 | Han et al. | 345/690 |
| 2008/0165103 | A1 * | 7/2008 | Lee | 345/88 |
| 2009/0213063 | A1 * | 8/2009 | Shimura | 345/102 |
| 2012/0242708 | A1 | 9/2012 | Tsai et al. | |
| 2012/0313136 | A1 | 12/2012 | Chung | |
| 2013/0020933 | A1 | 1/2013 | Levermore et al. | |

FOREIGN PATENT DOCUMENTS

| | | |
|---|---|---|
| EP | 1550947 | 7/2005 |
| EP | 2518543 | 10/2012 |

OTHER PUBLICATIONS

Effect of multi-walled carbon nanotubes on electron injection and charge generation in AC field-induced polymer electroluminescence Yonghua Chen, Gregory M. Smith, Eamon Loughman, Yuan Li, Wanyi Ni, David L. Carroll, Organic Electronics 14 (2013) 8-18.

http://hyperphysics.phy-astr.gsu.edu/%E2%80%8Chbase/vision/cie.html.

* cited by examiner

*Primary Examiner* — Viet Pham

(57) ABSTRACT

A display system, having an emissive body, varying light emitted from the surface in a way that each area becomes a pixel. The emissive body can be a FIPEL type device. Light can be both color varied and also color temperature controlled. The light color is changed by changing a frequency used to drive the body. Multiplexers can be used to reduce the number of generators needed.

20 Claims, 7 Drawing Sheets

ELECTROLUMINESCENT DISPLAY WHERE EACH PIXEL CAN EMIT LIGHT OF ANY EIA COLOR INDEX

BACKGROUND

From their first introduction, digital display panels have required astronomical numbers of components. The typical high definition display panel contains 1,080 "pixel groups" horizontally and 1,920 "pixel groups" vertically. Each pixel group contains 3 actual pixels, where one is red, one is green, and one is blue. When all three sub-pixels are "on", three colors are passed through the pixel gates which the eye perceives as coming from a single point source of light that appears white. The other colors mix in a similar way.

In total there are, for a high definition display of 1080 horizontal columns and 1920 vertical rows, 2,073,600 pixel groups with 6,220,800 individual sub-pixels requiring dozens of thin film transistors, resistors and capacitors to control each sub-pixel.

Traces carrying signals from control logic to sub-pixels are generally constructed of Indium Tin Oxide (ITO). ITO is used to interconnect all of the components together because of the translucency of ITO. The complexity of constructing a panel with the magnitude of modern panels speaks to the outstanding abilities of modern process engineering.

Current backlit LCD display panel assemblies commonly used in digital televisions contain a substantial number of components. These LCD panel assemblies require that light emitted from the back light be diffused, polarized then passed through a color filter film with colored microscopic dots aligned with the sub-pixels in the LCD panel. The pixels in a LCD panel are formed of 3 sub-pixels each of which is addressable by a column and row multiplexer. That multiplexer needs to address some 6,220,800 sub-pixels. These sub-pixels are each supported by at least a dozen discrete components comprised of Thin Film Transistors, capacitors and resistors. Control circuitry laid out on the LCD panel substrates are connected through thousands of traces of ITO material. Additionally, LCD panels require large light sources, diffusors, polarizer sheets and a color filter film. In all, there are millions of components required to support LCD panels.

SUMMARY

The present invention is an apparatus, method and system for eliminating LCD display panels with pixel subgroups having light provided by backlight panels and consequently reducing the parts count.

Embodiments describe a display made up of a matrix of pixel devices which can emit light of any color thereby reducing the number of addressable pixel subgroups from three to one and an associated reduction in the address lines of the column and row multiplexers.

The present invention is intended to eliminate components up to and including the LCD panel. FIPEL display panels have the ability to reduce the parts count by eliminating ⅔rds of the sub-pixels along with their share of the control circuits and traces.

BRIEF DESCRIPTION OF THE DRAWINGS

FIG. 8C is a depiction of the signal generator multiplexor and the rows of FIPEL pixels contained within a display screen.

DETAILED DESCRIPTION

Figure 9:
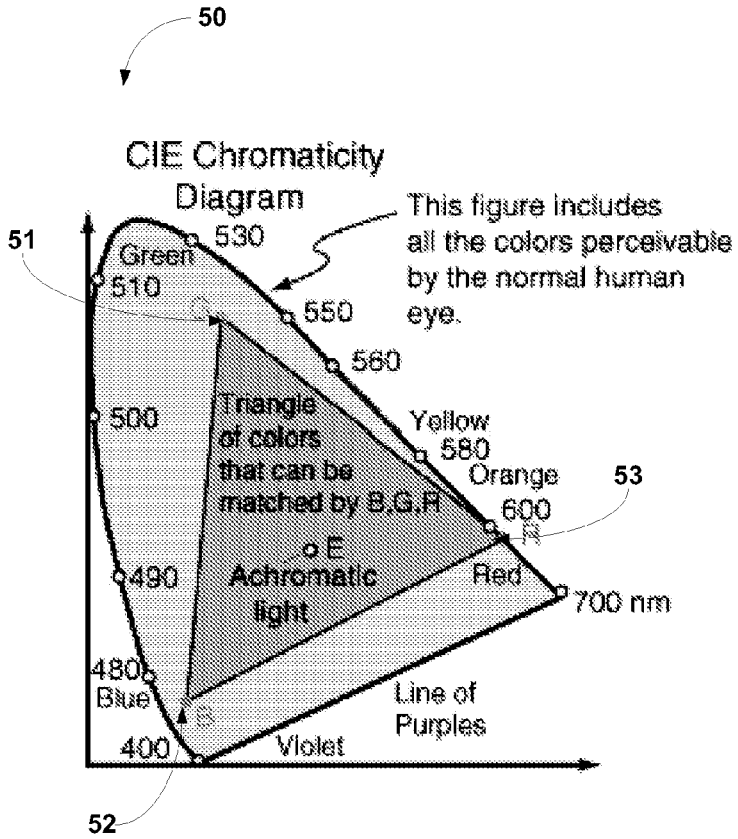
FIG. 9 is a depiction of the CIE color index with a triangle bounding the colors that are specified by the NTSC standard for television.

The present invention uses a lighting technology called Field Induced Polymer ElectroLumuinescence, referred to as FIPEL lighting. The present invention makes use of a matrix FIPEL of panels, each the size of a pixel group in which the single pixel can emit light of any color in the CIE color index. FIG. 9 shows the well known CIE color index chart. Note that 51, 52 and 53 point to the vertices of this diagram, with Green (51), Blue (52) and Red (53). These three vertices form the coordinates for a triangle that is the color space used for NTSC color television displays. Each of the point index values are 8 bits. Together this 3×8 bits, makes up the 24 bit color used for standard analog and digital color televisions.

FIPEL panels have the distinguishing feature of being able to emit colored light from any point on the CIE index bound by the triangle shown in FIG. 9. An embodiment makes use of this feature of FIPEL light panels by reducing the size of a FIPEL panel to the size of a pixel group. There are two immediate benefits to pixel size FIPEL panels. First, is the ability of the panel to emit light more efficiently. In a normal LCD panel, if only one pixel in a sub-group is "on" then ⅔rds of the light is attenuated. A typical LED backlight will supply approximately 500 candlepower of light to the LCD panel. If all of the pixels are on at one time then the amount of light that can pass through the LCD panel is substantially less than 500 candlepower because of structures residing between the backlight assembly and the LCD panel. These structures can include, for example, a diffusor sheet, a polarizer and a color microdot film for the sub-pixels. If only one sub-pixel in a sub-group is on, then only ⅓rd of the available light can pass through the panel.

With a FIPEL pixel panel that is being modulated according to the desired light output. All of the light generated by the light emissive pixel is available regardless of the color being emitted at any given time.

Another benefit is that these techniques alleviate the necessity of managing 6,220,800 individual sub-pixels. An embodiment reduces this by ⅓, only requiring the management of 2,073,600 individual pixels.

Another advantage of an embodiment is that white balance is included with management of individual pixels. White balance becomes an offset to the color of light being emitted from each individual pixel.

In another embodiment, the FIPEL panel color balanced backlight is divided into a plurality of individual panels where the color balance of each subpanel is separately controlled.

This allows the television to change the color temperature of the different portions of the display to enhance the viewing experience.

Figure 1:
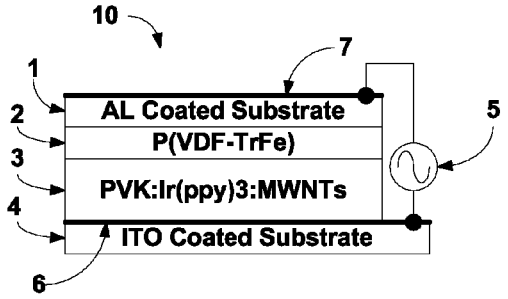
FIG. 1 is a depiction of an asymmetrical (single dielectric layer) FIPEL device that emits light from one surface.
Figure 2:
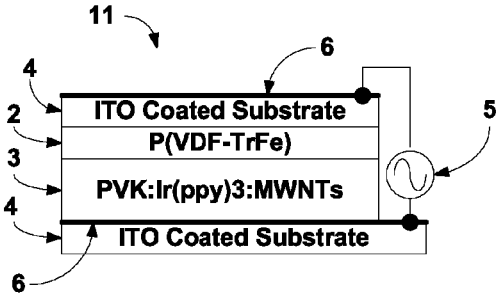
FIG. 2 is a depiction of an asymmetrical (single dielectric layer) FIPEL device that emits light from two surfaces.

To appreciate the simplicity of FIPEL devices reference FIGS. 1 and 2.

FIGS. 1 and 2 illustrate single dielectric FIPEL devices. The basic construction of these FIPEL devices is discussed in the following.

Lab quality FIPEL devices are generally fabricated on glass or suitable plastic substrates with various coatings such as aluminum and Indium tin oxide (ITO). ITO is a widely used transparent conducting oxide because of its two chief properties, it is electrical conductive and optical transparent, as well as the ease with which it can be deposited as a thin film onto substrates. Because of this, ITO is used for conducting traces on the substrates of most LCD display screens. As with all transparent conducting films, a compromise must be made between conductivity and transparency, since increasing the thickness increases the concentration of charge carriers which in turn increases the material's conductivity, but decreases its transparency. The ITO coating used for the lab devices discussed here is approximately 100 nm in thickness. In FIG. 1, emissive side substrate 4 is coated with ITO coating 6 residing against PVK layer 3. In FIG. 2, ITO coating 6 is on both substrates as shown.

Figure 3:
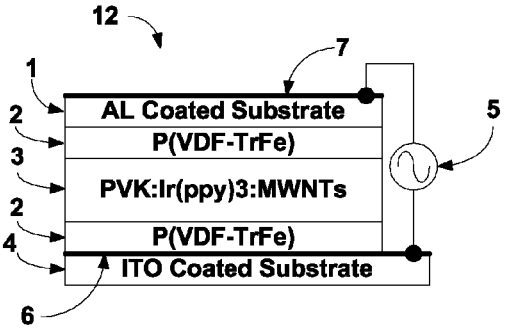
FIG. 3 is a depiction of a symmetrical (two dielectric layers) FIPEL device that emits light from one surface.
Figure 4:
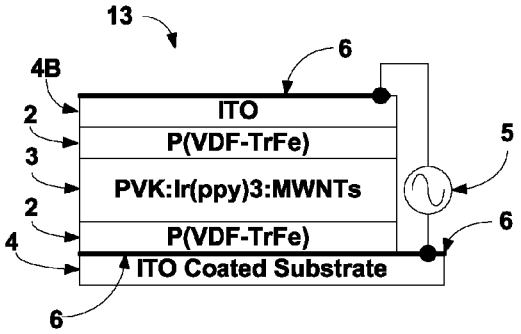
FIG. 4 is a depiction of a symmetrical (two dielectric layers) FIPEL device that emits light from two surfaces.

Substrate 1 in FIGS. 1 and 3 is coated with aluminum (AL) coating 7. The resulting thickness of the AL deposition is sufficient to be optically opaque and reflective. To ensure that any light from emissive layer 3 that travels toward substrate 1 is reflected and directed back through emissive substrate 4 with ITO coating 6 for devices illustrated in FIG. 1. If it is desired that light be emitted through both substrates, a substrate 4 with an ITO coating 6 can be substituted for substrate 1 with AL coating 5 as shown in FIG. 2.

The differences between the two similar substrates is in how ITO coating 6 is positioned. In FIG. 1, emissive ITO coating 6 is positioned such that ITO coating 6 on substrate 4 is physically in contact with PVK layer 3. In FIG. 2, substrate 1 with Al coating 7 (FIG. 1) is replaced with substrate 4 with ITO coating 6 not in physical contact with the P(VDF-TrFe) (dielectric layer) layer 2. This configuration allows light to be emitted from both the top and bottom surfaces of the FIPEL device.

Dielectric layer 2 in all cases is composed of a copolymer of P(VDF-TrFE) (51/49%). The dielectric layer is generally spin coated against the non-AL coated 7 side of substrate 1 or non-ITO coated 6 of substrate 4 of the top layer (insulated side). In all cases the dielectric layer is approximately 1,200 nm thick.

Emissive layer 3 is composed of a mix polymer base of poly(N-vinylcarbazole):fac-tris(2-phenylpyri-dine)iridium (III) [PVK:Ir(ppy)3] with Medium Walled Nano Tubes (MWNT). The emissive layer coating is laid onto the dielectric layer to a depth of approximately 200 nm. For the lab devices with the greatest light output the concentration of MWNTs to the polymer mix is approximately 0.04% by weight.

Carriers within the emissive layer then recombine to form excitons, which are a bound state of an electron and hole that are attracted to each other by the electrostatic force or field in the PVK host polymer, and are subsequently transferred to the Ir(ppy)3 guest, leading to the light emission.

When an alternating current is applied across the devices shown in FIGS. 1 and 2 (asymmetrical devices containing 1 dielectric layer) the emissive layer emits light at specific wavelengths depending on the frequency of the alternating current. The alternating current is applied across the conductive side of the top substrate 1 (Al coating 7) or substrate 4 and the conductive side (ITO coating 6) of bottom substrate 4. Light emission comes from the injection of electrons and holes into the emissive layer. Holes follow the PVK paths in the mixed emissive polymer and electrons follow the MWNTs paths.

The frequency of the alternating current applied across the substrates of the FIPEL panel determines the color of light emitted by the panel. Any index on the CIE can be duplicated by selecting the frequency of the alternating current. Signal generator 5 may be of a fixed frequency which is set by electronic components or set by a computer process that is software controlled. In this embodiment, the controlling software may consist of algorithms to balance white color or may determine the frequency based on hardware registers or data containing in the digital stream transporting the content to be displayed.

Figure 5:
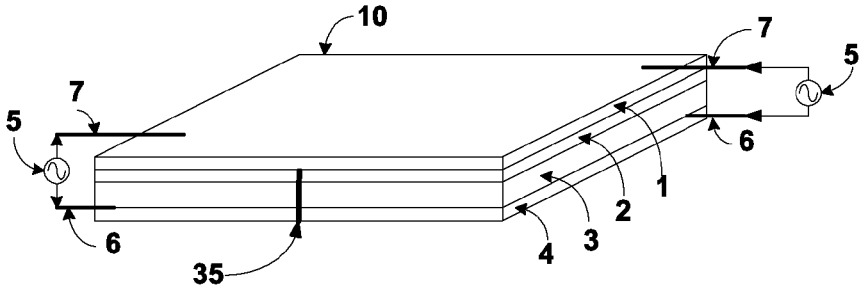
FIG. 5 is a depiction of two adjacent FIPEL cells that share a common front back substrate that is aluminum coated.
Figure 6:
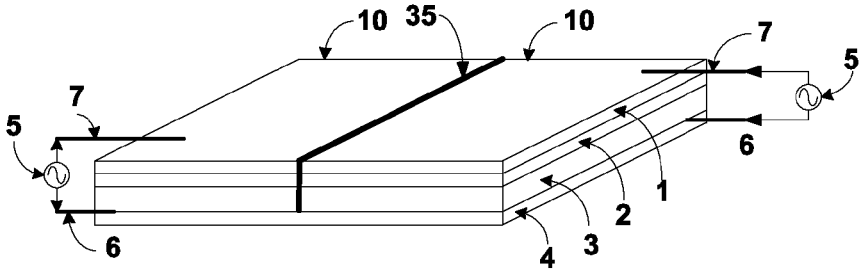
FIG. 6 is a depiction of two adjacent FIPEL cells that share a common front substrate which is the emissive substrate.

FIGS. 5 and 6 illustrate an embodiment using common substrates for adjacent FIPEL panels. FIG. 5 depicts an embodiment where adjacent FIPEL panels share back substrate 1 which is coated with aluminum 7 or ITO 6. In this embodiment, common substrate 1 acts as a single signal path to all of the panels. This embodiment decreases the parts count for control signal traces to each of the individual FIPEL panels. For a panel that is 1,080×1,920 the resulting decrease in the number of control lines is 4,147,200. Individual substrate 4 with ITO coating 6 acts as the controlled substrate for individual FIPEL pixels.

FIG. 6 depicts an embodiment where emissive substrate 4 with ITO coating 6 as the common substrate. In this embodiment substrate 1 with aluminum coating 7 is the controlled substrate for individual FIPEL pixels.

Figure 7:
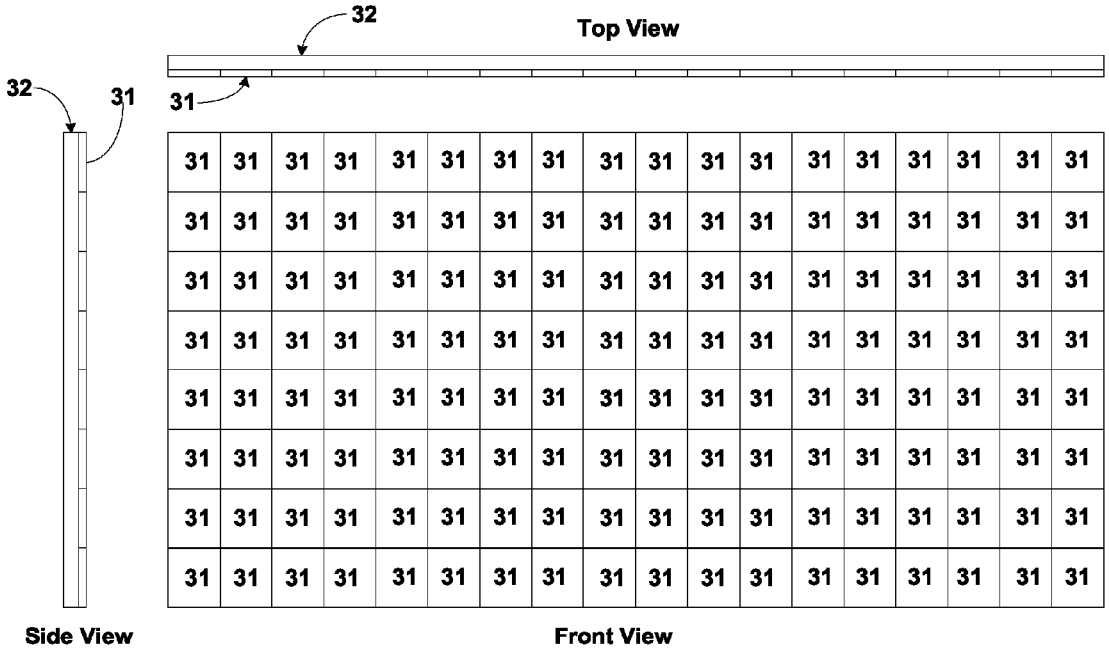
FIG. 7 is a depiction of a multi FIPEL backlight.

FIG. 7 depicts an embodiment where a multi-cell FIPEL panel acts as a backlight with zone dimming for a LCD spatial light modulator. In this embodiment, 144 individual FIPEL panels formed of 18 panels wide and 8 panels high provide the light for an LCD panel. The FIPEL panels that are located behind an area of the LCD where all of the pixels are "off" will not emit light which will improve the contrast ratio between lighted and non-lighted areas of the display screen. In this embodiment, each FIPEL panel 31 will be controlled by its own signal generator 5 which is controlled by processors and data contained in the content being displayed.

Figure 8A:
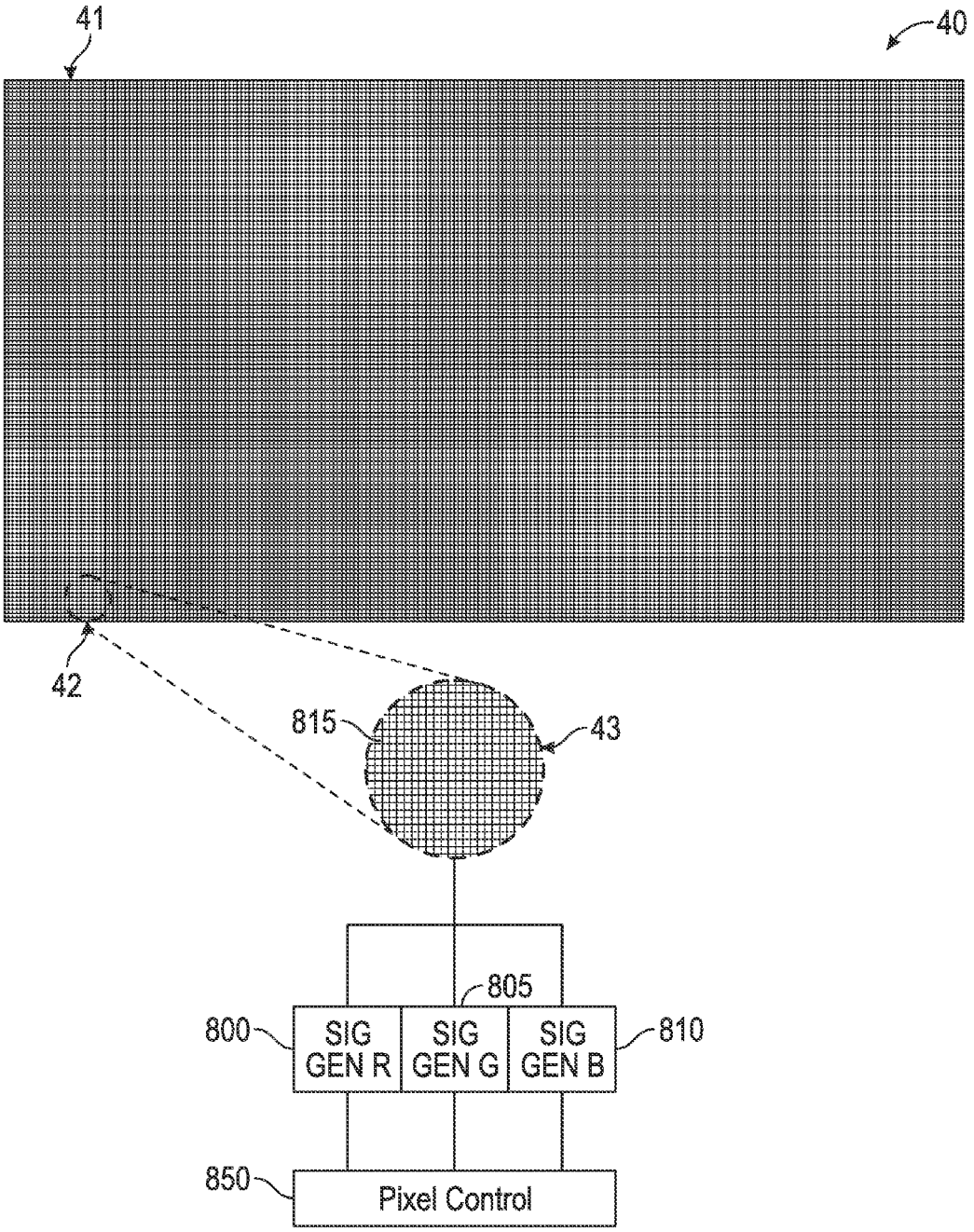
FIG. 8A is a depiction of is a depiction of a FIPEL pixel panel that contains 1,080 FIPEL pixels horizontally and 1,920 FIPEL pixels vertically.

FIG. 8A is a depiction of an embodiment with 1,080 FIPEL pixel sized panels wide and 1,920 FIPEL pixel sized panels high. This embodiment has 2,073,600 FIPEL pixel sized panels making up the display. This would require in one embodiment 2,073,600 signal generators, each to individually control the color of a single pixel. FIG. 8A shows this system, by showing 3 of the signal generators 800, 805, 810 collectively controlling the color of a single pixel 815. The signal generators are driven by a pixel control system shown as 850. This generically refers to any control system that receives a video signal in whatever form, and produces output indicative of the red green and blue pixels indicative of that video signal.

Figure 8B:
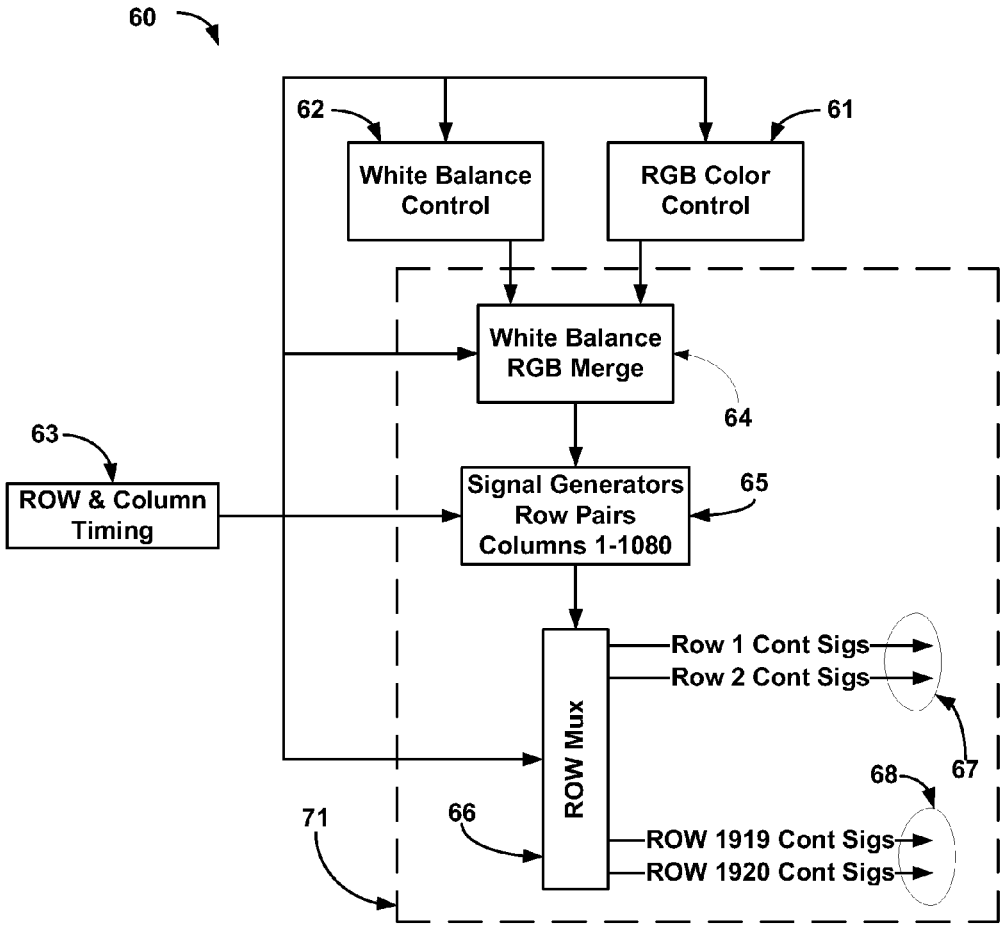
FIGS. 8B and 8C show embodiments with mulitplexers.

FIG. 8B is a depiction of the functional components making up the signal generator multiplexor. In this depiction 60 shows three functional components white balance RGB merge 64, signal generators row pairs for columns 1-1080 65 and row mux 66. In this depiction, white balance control 62 sets the basic value for color balanced white light and RGB color control 61 sets the color value for each pixel in the current two rows to be active. White balance RGB merge 64 takes the white balance control value for the pixels and the RGB color control value for each of the pixels and merges them such that a color value for each pixel is sent to signal generators row pairs columns 1-1080 65. Row & column timing 63 sends timing information to white balance control 62, RGB color control 61 and white balance RGB merge 64 so that those functional blocks know which pixel is being addressed. ROW & Column timing 63 also sends timing information to signal generators row pairs columns 1-1080 so that the white balance RGB merge information sent from white balance RGB merge 64 is received by the correct signal generator. The information from white balance RGB merge 64 contains the frequency a particular signal generator will oscillate at. This determines the color that will be emitted by a particular FIPEL pixel.

Once all of the signal generators in signal generators row pairs columns 1-1080 are generating their set frequencies, time information from ROW & Column timing 63 will cause ROW Mux 66 will switch the output lines from signal generators row pairs columns 1-1080 65 to the correct ROW mux output lines shown as 67 and 68. In this depiction output lines 67 carry the signal generator outputs for rows 1 and 2 columns 1-1080 and output lines 67 carry the signal generator outputs for rows 1919 and 1920 columns 1-1080. For the sake of clarity, the output lines for rows 3-1918 columns 1-1080 are not shown.

Figure 8C:
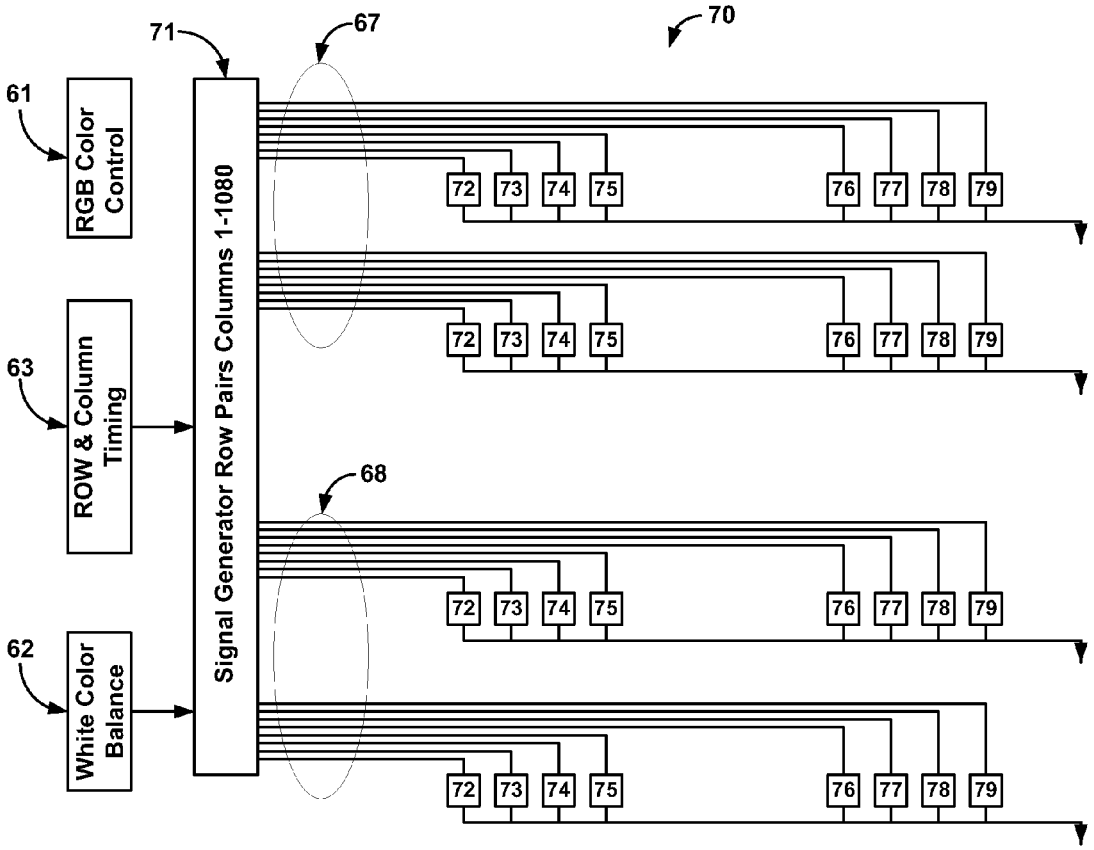

FIG. 8C is a higher level depiction of FIG. 8B. In FIG. 8C 70 depicts the relationship between the row and column pixels and the control electronics. In this depiction, 72 through 79 depict 8 pixels in a given row of 1,080 FIPEL pixels. Only the first 4 and last 4 pixels are depicted for each of 4 rows. In each row pixel 1 is depicted as 72, pixel 2 is depicted as 73, pixel 3 is 74, pixel 4 is 75 and pixel 1,077 is 76, pixel 1,078 is 77, pixel 1.079 is 78 and pixel 1,080 is 79. These are the relative numerical ordering of the pixels across the row. In each row depiction pixels 6 through 1,076 are not shown for the sake of clarity.

Note that FIPEL pixel rows 1 and 2 are depicted as 67 and FIPEL pixel rows 1,919 and 1,920 are depicted as 68.

Signal generator row pairs columns 1-1,080 contain the functional blocks white balance RGB merge 64 (FIG. 8B), signal generators row pairs columns 1-1,080 65 (FIG. 8B).

In depiction 70, two rows of FIPEL pixels will be emitting light at the same time. After rows 1 and 2 depicted as 67 have emitted light the next two rows in order to emit light. This continues until all row pairs have emitted light from each of their FIPEL pixels.

Depictions 60 and 70 are vastly simplified for the sake of clarity. A typical working model of these depictions which have row pairs greater than two rows. Typically the row pairs would contain 16, 34 or some greater number of rows that would be emitting light at the same time.

Those skilled in the art of multiplexor typically found in edge lit LCD light modulators will be familiar with the control logic depicted here in depictions 60 and 70.

Another embodiment reduces this large number of signal generators. In the FIG. 8B embodiment, signal generators sufficient to control one or more horizontal rows or vertical columns are used. FIG. 9-8B shows a signal generator pair 65 being driven by the pixel control circuit formed of both the RGB color control 61 and the white balance control 62, which are merged by the merge circuit 64. This drives a pair of signal generators 65. The output of the signal generator 65 is output to a multiplexer 66 whose output is connected to a group of pixels shown generically as 66, 67, under control of the row and column timing 63. The group of pixels can be of any shape or size, and can also be configurable by the multiplexer 66 and or by the pixel control circuit. The multiplexer controls pixel outputs being sent to the pixel circuits. In one embodiment, the multiplexer may produce different outputs at different times, with the pixels retaining their value at times between the times that they are refreshed by the multiplexer. In another embodiment shown in FIG. 8C, the multiplexer may be switched to control only those pixels that have the same color at the same time. Current LCD digital displays use row and column multiplexers to address pixel groups. The same concept can be used to control FIPEL pixel rows and columns with the exception being that far fewer control lines are needed due to a single FIPEL pixel being able to emit any color on the CIE index bound by a triangle that contains the NTSC colors.

In FIG. 8A, 40 shows FIPEL pixel panel 41. The depiction is not to scale as to the number of pixels shown in the rows and columns for the sake of clarity. 42 is an area of the FIPEL pixel panel 41 which is shown in magnification as 43.

This technique can also be used with the new Samsung screen technology called Electro-wetting Displays which may have backlights or have only have reflective back surfaces that reflect ambient light. A FIPEL panel of the type shown in the embodiments can provide both. When the FIPEL panel is active with this type of display, the display is using a backlight. When the FIPEL panel is turned off, the reflective back surface of the FIPEL panel is reflective. This gives the Electro-wetting Display the best of both worlds.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended for cover any modification or alternatives which might be predictable to a person having ordinary skill in the art. For example, other sizes and thicknesses can be used. While the above discusses use of liquid crystal (LCD) as the spatial light modulator, this is intended to supplant other forms of SLMs as well.

Those of skill in the art would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments.

The various illustrative logical blocks, modules, and circuits described in connection with the embodiments disclosed herein, may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has a user interface port that communicates with a user interface, and which receives commands entered by a user, has at least one memory (e.g., hard drive or other comparable storage, and random access memory) that stores electronic information including a program that operates under control of the processor and with communication via the user interface port, and a video output that produces its output via any kind of video output format, e.g., VGA, DVI, HDMI, display port, or any other form. This may include laptop or desktop computers, and may also include portable computers, including cell phones, tablets such as the IPAD™, and all other kinds of computers and computing platforms.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, using cloud computing, or in combinations. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of tangible storage medium that stores tangible, non transitory computer based instructions. An exemplary storage medium is coupled to the processor such that the processor can read information from, and write information to, the storage medium. In the alternative, the storage medium may be integral to the processor. The processor and the storage medium may reside in reconfigurable logic of any type.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer.

The memory storage can also be rotating magnetic hard disk drives, optical disk drives, or flash memory based storage drives or other such solid state, magnetic, or optical storage devices. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, or operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A display system, comprising an emissive body, having an emissive surface, arranged into multiple separate areas, each area defining a pixel of a display being displayed, a pixel control circuit that receives first information indicative of a color of a pixel of the display, and second information indicative of a white balance, and combines said first and second information to create a signal indicative of a merged color;

a plurality of signal generators, respectively connected to drive different areas on said emissive body, where a frequency of each of the signal generators is controlled by a level of the signal indicative of the merged color, to vary a color emitted by each separate area of the emissive body, being driven by the signal generator, anywhere between a level of R, G and B being controlled according to any color bound by a triangle in a chromaticity diagram that bounds all NTSC colors, and the level being controlled by the frequency of the signal generators;

wherein each said area becomes a pixel of the display by displaying a color of the pixel.

2. The display system as in claim 1, wherein each area has a red component, a green component, and a blue component, all of which are displayed at the same time.

3. The display system as in claim 1, further comprising multiplexers that control each signal generator controlling colors of multiple ones of said separate areas, by connecting said signal generator to different areas.

4. The display system as in claim 3, wherein said multiplexers connect the signal generators to plural different pixels which have the same color at the same time.

5. The display system as in claim 1, further comprising a controllable spatial light modulator, having multiple individual controllable pixels, said multiple pixels being illuminated by said emissive body, and said pixels each modulating the light from said emissive body.

6. The display system as in claim 5, wherein said spatial light modulator is liquid crystal, forming a liquid crystal display.

7. The display system as in claim 6 wherein said spatial light modulator is composed of elements that are one of: TFT, VA, IPS, IGZO or an electrowetting display.

8. The display system as in claim 1, wherein the display system is a television.

9. This display system as in claim 1 wherein the display system is in a portable computer.

10. The display system as in claim 9, wherein said portable computer is one of a tablet, cell phone, or PDA.

11. A method of display, comprising controlling an emissive body, having an emissive surface, such that each of multiple separate areas are controlled to emit in separate colors, each area defining a pixel of a display being displayed, said controlling comprising receiving first information indicative of a color of a pixel of the display, receiving second information indicative of a white balance, and combining said first and second information to create a signal indicative of a merged color, and using signals indicative of the merged color to control respective frequencies of a plurality of signal generators, where a frequency of each of the signal generators is controlled by a level of the signal indicative of the merged color, connecting the frequency from the signal generator to different areas on said emissive body, said controlling varying the frequency output of the signal generators to vary a color emitted by each separate area of the emissive body being driven by the signal generator, anywhere within a triangle in a chromaticity diagram that bounds all NTSC colors;

displaying such that each said area becomes a pixel of the display by displaying a color of the pixel.

12. The method of display as in claim 11, further comprising varying said color by varying a frequency of said signal generators for each area to have a red component, a green component, and a blue component, all of which are displayed at the same time.

13. The method of display as in claim 11, further comprising multiplexing a control of the signal generators to control colors of multiple ones of said separate areas, by connecting a signal generator to different areas.

14. The method of display as in claim 13, wherein said multiplexers connect the signal generators to plural different pixels which have the same color at the same time.

15. The method of display as in claim 11, further comprising controlling a controllable spatial light modulator, having multiple individual controllable pixels, said multiple pixels being illuminated by said emissive body, and said pixels each modulating the light from said emissive body.

16. The method of display as in claim 15, wherein said spatial light modulator is liquid crystal, forming a liquid crystal display.

17. The method of display as in claim 16 wherein said spatial light modulator is composed of elements that are one of:

TFT, VA, IPS, IGZO or an electrowetting display.

18. The method of display as in claim 11, wherein the method of display is in a television.

19. This method of display as in claim 11 wherein the method of display is in a portable computer.

20. The method of display as in claim 19, wherein said portable computer is one of a tablet, cell phone, or PDA.

* * * * *